US008577263B2

(12) United States Patent
Mase

(10) Patent No.: US 8,577,263 B2
(45) Date of Patent: Nov. 5, 2013

(54) DEVELOPING DEVICE

(75) Inventor: Soichiro Mase, Handa (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 226 days.

(21) Appl. No.: 12/636,816

(22) Filed: Dec. 14, 2009

(65) Prior Publication Data

US 2010/0166458 A1 Jul. 1, 2010

(30) Foreign Application Priority Data

Dec. 26, 2008 (JP) ..... 2008-333839

(51) Int. Cl.
*G03G 15/08* (2006.01)

(52) U.S. Cl.
USPC ..... 399/254; 399/119; 399/113; 399/110; 399/13; 399/90; 399/117; 399/26; 399/88

(58) Field of Classification Search
USPC ..... 399/119, 254, 113, 110, 26, 117, 88, 13
See application file for complete search history.

(56) References Cited

U.S. PATENT DOCUMENTS

| | | | | |
|---|---|---|---|---|
| 5,179,414 | A * | 1/1993 | Bhagat | 399/258 |
| 5,188,057 | A | 2/1993 | Ishikawa et al. | |
| 5,867,756 | A * | 2/1999 | Suzuki et al. | 399/255 |
| 5,913,097 | A | 6/1999 | Nakano et al. | |
| 6,029,019 | A | 2/2000 | Kawai | |
| 6,072,969 | A * | 6/2000 | Yokomori et al. | 399/119 |
| 6,345,164 | B1 | 2/2002 | Yokomori et al. | |
| 6,421,517 | B1 | 7/2002 | Nishino et al. | |
| 7,163,032 | B2 | 1/2007 | Itabashi | |
| 7,787,806 | B2 | 8/2010 | Sato | |

(Continued)

FOREIGN PATENT DOCUMENTS

| | | | |
|---|---|---|---|
| CN | 1936723 | A | 3/2007 |
| JP | 07-140788 | A | 6/1995 |

(Continued)

OTHER PUBLICATIONS

Extended EP Search Report dtd Apr. 13, 2010, EP Appln. 09178859.6.

(Continued)

*Primary Examiner* — David Porta
*Assistant Examiner* — Djura Malevic
(74) *Attorney, Agent, or Firm* — Banner & Witcoff, Ltd.

(57) ABSTRACT

A developing device includes a developing unit having a developing frame defining therein a developing chamber and a developing roller rotatably disposed in the developing chamber, and a developing agent unit including a developing agent container that accommodates therein a developing agent, and an agitator disposed in the developing agent container and rotatable about a rotation axis in a rotational direction to agitate the developing agent. The developing agent container includes an arcuate bottom wall whose center of radius of a curvature is coincident with the rotation axis, and an arcuate protruding wall protruding from the bottom wall toward the developing chamber and positioned downstream of the bottom wall in the rotational direction. The protruding wall is formed with an opening providing a fluid communication between an interior of the developing agent container and the developing chamber. The opening has a downstream end in the rotational direction in an operational state. The bottom wall and the protruding wall have inner surfaces extending diagonally upward from a lowermost point of the bottom wall to the downstream end in the operational state.

9 Claims, 4 Drawing Sheets

(56) References Cited

U.S. PATENT DOCUMENTS

| | | | | |
|---|---|---|---|---|
| 2003/0161657 | A1 | 8/2003 | Yokoi et al. | |
| 2004/0134560 | A1 | 7/2004 | Sato et al. | |
| 2004/0234293 | A1 | 11/2004 | Karakama | |
| 2006/0193644 | A1* | 8/2006 | Takagi | 399/12 |
| 2007/0059038 | A1* | 3/2007 | Shiraki | 399/119 |
| 2007/0071503 | A1 | 3/2007 | Sato | |
| 2007/0258732 | A1 | 11/2007 | Tanaka | |
| 2009/0035028 | A1* | 2/2009 | Itabashi | 399/286 |
| 2009/0169245 | A1* | 7/2009 | Sato | 399/111 |
| 2010/0278566 | A1 | 11/2010 | Sato | |

FOREIGN PATENT DOCUMENTS

| | | | |
|---|---|---|---|
| JP | 10-312104 | | 11/1998 |
| JP | 2003-248370 | A | 9/2003 |
| JP | 03-504909 | | 3/2004 |
| JP | 2004-118093 | A | 4/2004 |
| JP | 2004-302334 | A | 10/2004 |
| JP | 03-680479 | | 8/2005 |

OTHER PUBLICATIONS

CN Office Action dated Sep. 22, 2011, corresponding Application No. 200910215109.6; English Translation.

JP Office Action dated Aug. 21, 2012 in corresponding JP Application No. 2008-333839; English Translation.

CN Office Action dated Jul. 13, 2012, corresponding Application No. 200910215109.6; English Translation.

* cited by examiner

DEVELOPING DEVICE

CROSS REFERENCE TO RELATED APPLICATION

This application claims priority from Japanese Patent Application No. 2008-333839 filed Dec. 26, 2008. The entire content of the priority application is incorporated herein by reference.

TECHNICAL FIELD

The present invention relates to a developing device having a developing chamber and a toner cartridge.

BACKGROUND

Generally, an image forming device such as laser printer has a developing device that supplies developer (hereinafter called "toner") onto an electrostatic latent image formed on a photosensitive body. A conventional developing device has a toner cartridge and a developing chamber. In the toner cartridge, an agitator is provided to supply toner to the developing chamber through an opening. In the developing chamber, a toner supply roller and a developing roller are provided for supplying the toner to the photosensitive drum.

In this developing device, cylindrical toner cartridge and developing chamber are juxtaposed with each other in substantially horizontal direction and communicate with each other. If an amount of the toner in the developing chamber reaches a predetermined amount, a part of the toner flows into toner cartridge through the opening. Then, the agitator mixes the toner flowing into toner cartridge and the toner contained originally in the toner cartridge, and the mixed toner is supplied to the developing chamber. As a result, the toner circulates between the developing chamber and the toner cartridge.

In such a toner recirculation type developing device, a vertical size of the developing chamber is relatively large, so that an internal volume of the developing chamber increases to increase an amount of the toner in the developing chamber. Therefore, large amount of degraded toner remains in the developing chamber in case of replacement of old toner cartridge with a new cartridge.

In this case, the problem is that toner remaining in the developing chamber has a polarity which is opposite to an intended polarity, or toner aggregation may occur in the remaining toner. These toner may be deposited on the photosensitive drum, to degrade the quality on the image. Such disadvantageous phenomena occurs when the degraded toner and new toner is mixed with each other to some extent by the movement of the toner between toner cartridge and the developing chamber, that is, shortly after new toner is supplied to the remaining toner.

SUMMARY

However, according to such conventional developing device that has large volume developing chamber, mixing degraded toner and new toner takes much time. As a result, the degradation of image cannot be obviated just after new toner is supplied.

Therefore, it is an object of the present invention to provide a developing device capable of restraining degradation of the imaging quality immediately after the supply of a new toner.

This and other objects of the invention will be attained by providing a developing device including a developing unit and a developing agent unit. The developing unit includes a developing frame defining therein a developing chamber, and a developing roller rotatably disposed in the developing chamber. The developing agent unit includes a developing agent container and an agitator. The developing agent container is configured to accommodate a developing agent. The agitator is disposed in the developing agent container and is rotatable about a rotation axis in a rotational direction to agitate the developing agent. The developing agent container includes an arcuate bottom wall and an arcuate protruding wall. A center of radius of a curvature of the arcuate bottom is configured to coincident with the rotation axis. The arcuate protruding wall protrudes from the bottom wall toward the developing chamber and is positioned downstream of the bottom wall in the rotational direction. The arcuate protruding wall has an opening providing a fluid communication between an interior of the developing agent container and the developing chamber. The bottom wall includes a lowermost point, and the opening having a downstream end in the rotational direction in an operational state. The bottom wall and the protruding wall have inner surfaces extending diagonally upward from the lowermost point to the downstream end in the operational state.

According to another aspect, the present invention provides a developing cartridge including a developing agent container and an agitator. The developing agent container accommodates therein a developing agent. The agitator is disposed in the developing agent container and is rotatable about a rotation axis in a rotational direction to agitate the developing agent. The developing agent container includes an arcuate bottom wall and an arcuate protruding wall. A center of radius of a curvature of the bottom wall is coincident with the rotation axis. The arcuate bottom wall has a lowermost point and an inner surface. The arcuate protruding wall has an inner surface and protrudes from the bottom wall in a direction away from the rotation axis and is positioned downstream of the bottom wall in the rotational direction. The protruding wall is formed with an opening through which the developing agent is discharged from the developing agent container to an outside. The opening has an upstream end and a downstream end in the rotational direction. The protruding wall has a center point defining a radius of a curvature of the protruding wall, the center point positioned at a side of the rotation axis with respect to a first imaginary vertical plane passing through the upstream end in an operational state. The inner surfaces of the bottom wall and the protruding wall extend diagonally upward from the lowermost point to the downstream end in the operational state.

BRIEF DESCRIPTION OF THE DRAWINGS

In the drawings:

FIG. 4(*b*) is a cross-sectional view of the developing device showing a state where the new toner is conveyed to an opening; and FIG. 4(*c*) is a cross-sectional view of the developing device showing a state where the new toner is mixed with old toner.

DETAILED DESCRIPTION

Figure 1:
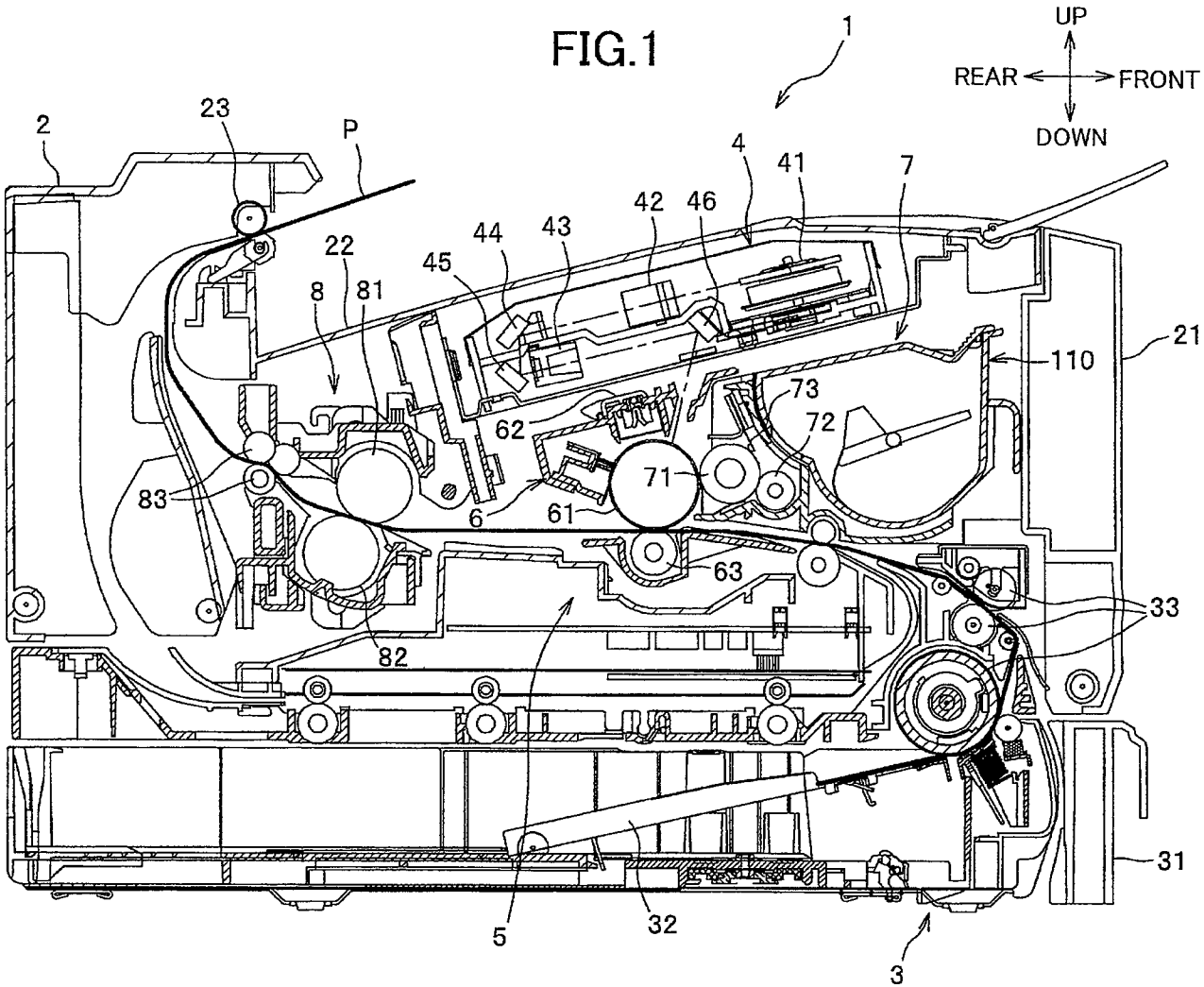
FIG. 1 is a cross-sectional side view of a laser printer equipped with a developing device according to one embodiment of the invention.

An image forming device equipped with a developing device according to one embodiment of the invention will be described with reference to FIGS. 1 through 4(*c*). The image forming device is a laser printer. In the following description, the terms "upward", "downward", "upper", "lower". "above", "below" and the like will be used assuming that the laser printer is disposed in an orientation in which it is intended to be used. In FIG. 1, right side and left side are front side and rear side, respectively.

As shown in FIG. 1, the laser printer 1 mainly includes a main frame 2 and, within the main frame 2, a sheet supply unit 3 for supplying a sheet of paper, an exposure unit 4, process cartridge 5 for transferring the toner to the sheet P, and fixing unit 8 that thermally fixes the toner transferred to the sheet P are provided. The main frame 2 includes a front cover 21 pivotally movable.

The sheet supply unit 3 is provided on a lower portion of the main frame 2. The sheet supply unit 3 includes a sheet cassette 31, a lifter plate 32 for lifting a front side of the sheet P, and various types of rollers 33 for conveying and separating the sheet, and removing dust of the sheet. The sheet in the sheet cassette 31 is lifted upward by the lifter plate 32, and an uppermost sheet in the sheet cassette 31 is conveyed toward the process cartridge 5 by the various types of rollers 33.

The exposure unit 4 is provided on an upper portion of the main frame 2. The exposure unit 4 includes a polygon mirror 41 that is rotationally driven, lenses 42, 43, reflection mirrors 44, 45 and 46, and a laser light emitting portion (not shown). The laser light emitting portion is adapted to emit a laser beam based on image data. As illustrated by a dotted chain line in FIG. 1, the laser beam proceeds the polygon mirror 41, lens 42, reflecting mirrors 44, 45, lens 43 and reflecting mirror 46 in this order and is irradiated on a surface of a photosensitive drum 61.

The process cartridge 5 is disposed below the exposure unit 4. The process cartridge 5 is detachably mounted in the main frame 2 and is accessible through an opening which is formed when the front cover 21 is open. The process cartridge 5 includes a drum unit 6 and developing device 7 detachably mounted on the drum unit 6.

The drum unit 6 mainly includes the photosensitive drum 61, a charger 62, and a transfer roller 63. The developing device 7 includes a developing roller 71, a supply roller 72, a thickness regulating blade 73, and a toner container 110. The detail description of the developing device 7 will be described later.

In the process cartridge 5, after the charger 62 charges the surface of the photosensitive drum 62, a laser beam emitted from the exposure unit 4 based on image data is scanned at a high speed over the surface of the photosensitive drum 61, forming an electrostatic latent image corresponding to the image data. Toner accommodated in the toner container 110 is carried to the developing roller 71 through the supply roller 72, and a toner layer having a uniform thickness is provided over the surface of the developing roller 71 by the thickness regulating blade 73.

Next, toner carried on the developing roller 71 is supplied to an area of the electrostatic latent image formed on the photosensitive drum 61. In this way, a visible toner image corresponding to the electrostatic latent image can be formed on the surface of the photosensitive drum 61. Subsequently, the sheet P is fed between the photosensitive drum 61 and the transfer roller 63, and the toner image supported on the surface of the photosensitive drum 61 is transferred onto the sheet 3.

The fixing unit 8 is disposed rearward of the process cartridge 5 and includes a heat roller 81, a pressure roller 82, and conveying roller 83. The pressure roller 82 nips the sheet P in cooperation with the heat roller 81. The conveying roller 83 transfers the sheet P on which the image has been fixed. Toner transferred onto the sheet P is thermally fixed as the sheet P passes between the heating roller 81 and the pressure roller 82. The sheet P on which toner image has been fixed is conveyed outside the frame 2 by the conveying roller 83, and is discharged onto a discharge tray 22 by a discharge rollers 23.

Next, a configuration of the developing device 7 will be described in detail. The description described below is based on the condition where the developing device 7 is mounted in the main frame 2 as shown in FIG. 1. In the following description, the term "upstream" refers to the upstream side in the rotational direction of an agitator 120 (arrow direction in FIG. 2) and the term "downstream" refers to the downstream side in the rotational direction.

Figure 2:
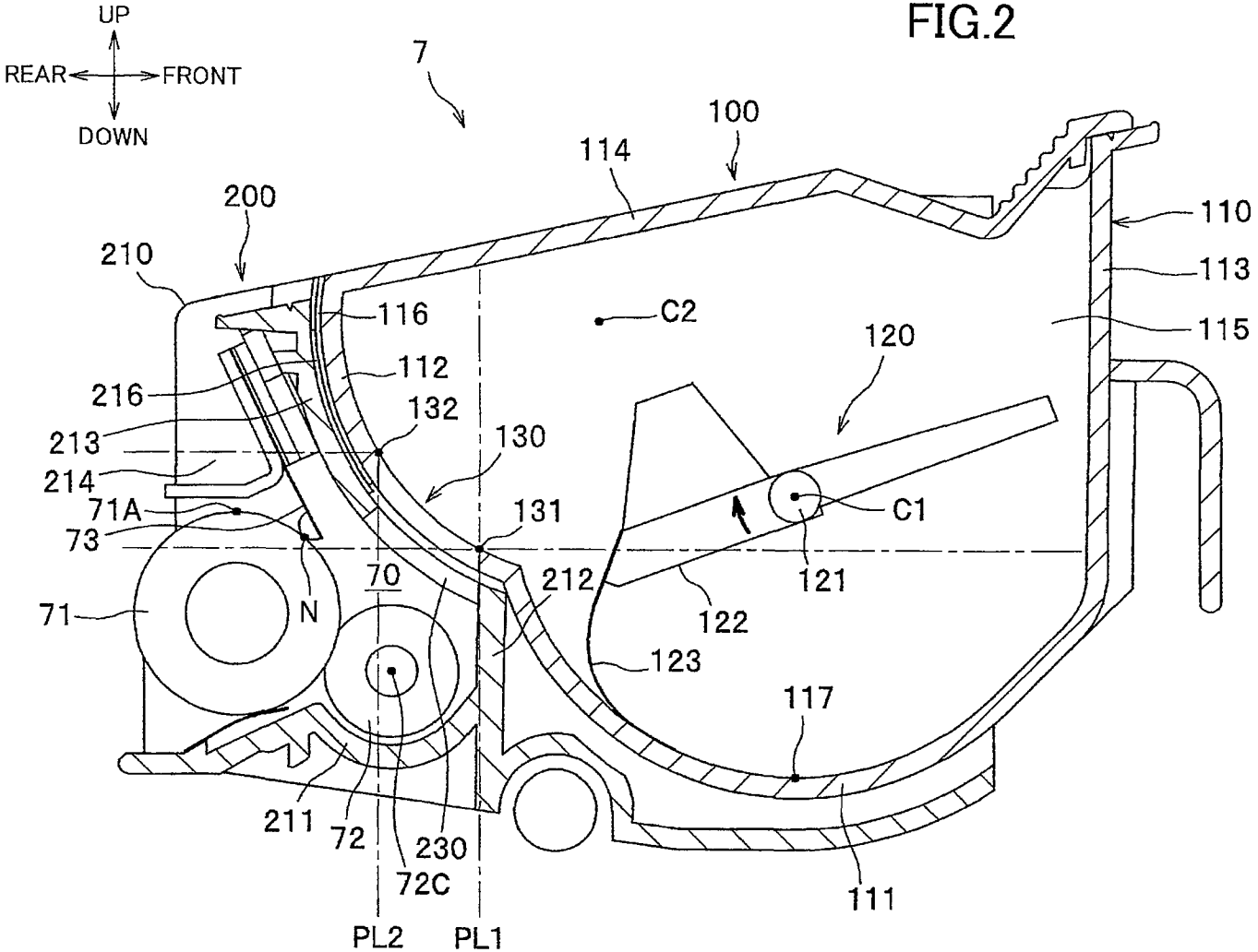
FIG. 2 is a cross-sectional view of the developing device according to one embodiment of the invention.
Figure 3:
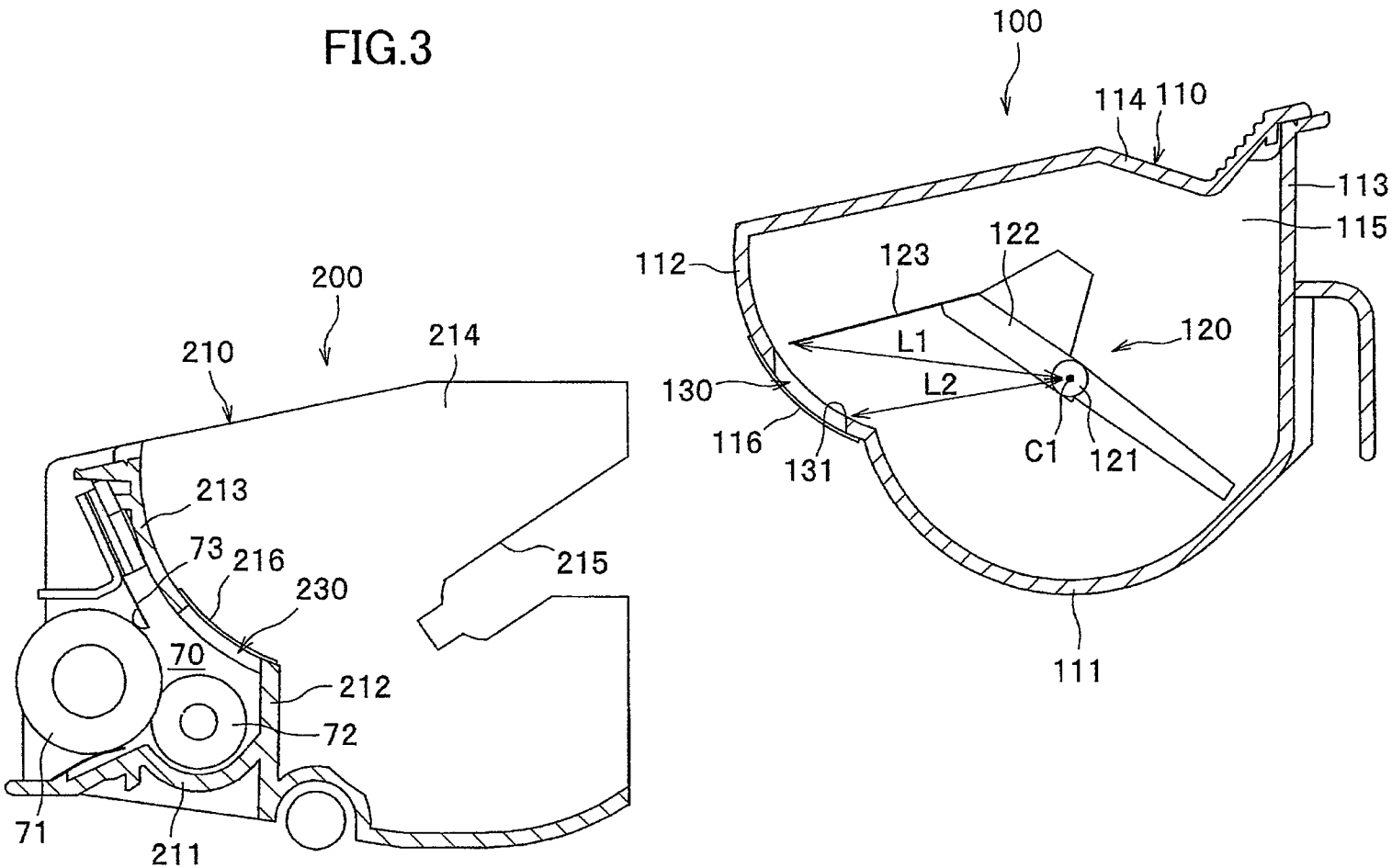
FIG. 3 is a cross-sectional view of the developing device showing a state where a toner cartridge and a developing unit is separated.

As shown in FIG. 2, the developing device 7 includes a toner cartridge 100 (or developing cartridge) and a developing unit 200. As shown in FIG. 3, the toner cartridge 100 is configured to be detachably mounted in the developing unit 200. The toner cartridge 100 mainly includes the toner container 110 and the agitator 120 disposed in the toner container 110.

The toner container 110 is a case which contains toner. The toner container 110 has a bottom wall 111, a protruding wall 112, a front wall 113, an upper wall 114 and a pair of side walls 115. A bottommost part and a rear part of the bottom wall 111 have an arcuate cross-section whose center of radius is coincident with a rotation axis C1 of the agitator 120.

The protruding wall 112 has an arcuate cross-section, and protrudes rearward (toward a developing chamber 70) from a most downstream end of the bottom wall 111. The protruding wall 112 has a lower portion formed with an opening 130 extending in a lateral direction (widthwise direction of a sheet) and allowing fluid communication between the developing chamber 70 and the toner container 110. The opening 130 has a lateral width greater than an imaging width, and approximately the same as a lateral with of the developing device 7. Note that the opening 130 is a single successive opening. However, the opening 130 can be divided into a plurality of openings arrayed in line in the lateral direction. The protruding wall 112 has a center C2 of a radius of curvature. The center C2 is positioned closer to the center C1 than a most upstream end 131 of the opening 130 to the center C1.

An arcuate shutter 116 is provided at an outer surface of the protruding wall 112. The shutter 116 is pivotally movable manually or electrically along the outer surface between a closing position for closing the opening 130 as shown in FIG. 3 and an open position for opening the opening 130 as shown in FIG. 2.

Because of the pivotal sliding movement of the shutter 116 with respect to the outer surface of the protruding wall 112, sealability to the opening 130 can be improved to avoid leakage of the toner from the toner container 110. Further, a space for resting the shutter 116 at its opening position can be reduced, thereby realizing a compact toner cartridge 100.

As shown in FIG. 2, the bottom wall 111 and the protruding wall 112 have inner arcuate surfaces oriented diagonally upward and rearward from a lowermost point 117 of the bottom wall 111 to a most downstream end 132 of the opening 130. More specifically, the inner arcuate surfaces are discontinuous from each other, and each inner surface is oriented diagonally upward and rearward from the lowermost point 117 to the most downstream end 132.

The agitator 120 is adapted for agitating the toner in the toner container 110 and to convey the toner to the developing chamber 70 through the opening 130 during rotating phase. The agitator 120 includes an agitation shaft 121, an arm 122 and a sheet member 123.

The agitation shaft 121 extends laterally and has each end portion rotatably supported by the side wall 115 of the toner container 110. The agitation shaft 121 has the rotation axis C1 positioned higher than the most upstream end 131 of the opening 130. A motor (not shown) is provided in the main frame 2. A rotation of the motor is transmitted to the agitator 120 for rotating the agitation shaft 121, so that the sheet member 123 is circularly moved within the toner container 110.

The arm 122 extends from the agitation shaft 121 in a radial direction thereof, and the sheet member 123 made from a flexible and resilient material. The sheet member 123 has a base end portion adhesively fixed to a free end portion of the arm 122. The sheet member 123 is in sliding contact with the inner surfaces of the front wall 113 and the bottom wall 111 so as to agitate and convey the toner toward the opening 130. The sheet member 123 is configured so that a distance length L1 from the rotation center C1 to a free end of the sheet member 123 during its stretching state as shown FIG. 3 is greater than a distance L2 from the rotation center C1 to the most upstream end 131 of the opening 130.

As shown in FIG. 2, the developing unit 200 includes a developing frame 210, the developing roller 71, the toner supply roller 72 those rotatably supported to the developing frame 210, and the thickness regulation blade 73 in sliding contact with an outer peripheral surface of the developing roller 71 for regulating a thickness of a toner layer formed thereover.

The developing frame 210 defines therein the developing chamber 70 in which the developing roller 71 and the toner supply roller 72 are disposed. The developing chamber 70 is constituted by a bottom wall portion 211, a lower front wall portion 212, an upper front wall portion 213, and a pair of side wall portions 214 (one of the side wall portions 214 is shown in FIG. 2).

The developing roller 71 and the toner supply roller 72 are positioned adjacent to an inner surface of the bottom wall portion 211, whose contour is in conformance with an outer peripheral curvature of the toner supply roller 72. The lower front wall 212 is positioned frontward of the toner supply roller 72 and extends vertically.

The upper front wall portion 213 protrudes rearward from an upper end of the lower front wall portion 212, and has an arcuate shape in conformance with that of the protruding wall 112 of the toner container 110 in such a manner that a center of radius of curvature of the upper front wall portion 213 is coincident with the center C2. The upper front wall portion 213 has a lower portion formed with an opening 230 at a position in alignment with the opening 130 to provide fluid communication between the developing chamber 70 and the toner container 110.

The upper front wall portion 213 has an outer side (a front side confronting the protruding wall 112) provided with a shutter 216. The shutter 216 is pivotally movable manually or electrically along the outer surface between a closing position for closing the opening 230 as shown in FIG. 3 and an open position for opening the opening 230 as shown in FIG. 2.

The toner supply roller 72 is positioned below the openings 130, 230 and higher than the lowermost point 117 at the inner surface of the bottom wall 111. Further, the toner supply roller 72 has a rotation axis 72C positioned between a vertical plane PL1 passing through the upstream end 131 of the opening 130 and another vertical plane PL2 passing through the downstream end 132 of the opening 130.

The developing roller 71 is positioned immediately rearward of the toner supply roller 72 and in contact therewith. The developing roller 71 has a rear portion exposed to an outside, and has an uppermost end 71A positioned higher than the upstream end 131 of the opening 130. Further, the blade 73 is in contact with the outer peripheral surface of the developing roller 71 at a nip area N which is positioned higher than the upstream end 131 and lower than the downstream end 132.

Each side wall portion 214 has a front portion formed with a groove 215 extending diagonally downward and rearward so as to allow each end portion of the agitation shaft 121 to be inserted into each groove 215, whereupon the toner cartridge 100 is assembled to the developing frame 210.

Next, operation of the developing device 7 will be described with reference to FIGS. 4(*a*) through 4(*c*). The description pertains to a condition where a new toner cartridge 100 is assembled to the developing unit 200 to supply new toner to the developing chamber 70. First, the process cartridge 5 including the developing device 7 is assembled to the main frame 2 as shown in FIG. 1. The developing device 7 includes a new toner cartridge 100 assembled to the developing unit 200. In a non-operational state of the laser printer 1 (prior to rotation of the developing roller 71 and the agitator 120), degraded toner T remains in the developing chamber 70 as shown in FIG. 4(*a*).

In the depicted embodiment, the protruding wall 112 of the toner container 110 largely protrudes toward the developing chamber 70, thereby reducing an internal space above the toner supply roller 72. Accordingly, an internal volume of the developing chamber 70 can be reduced. Consequently, an amount of degraded toner T remaining in the developing chamber 70 can be reduced in comparison with a conventional developing device.

Figure 4A:
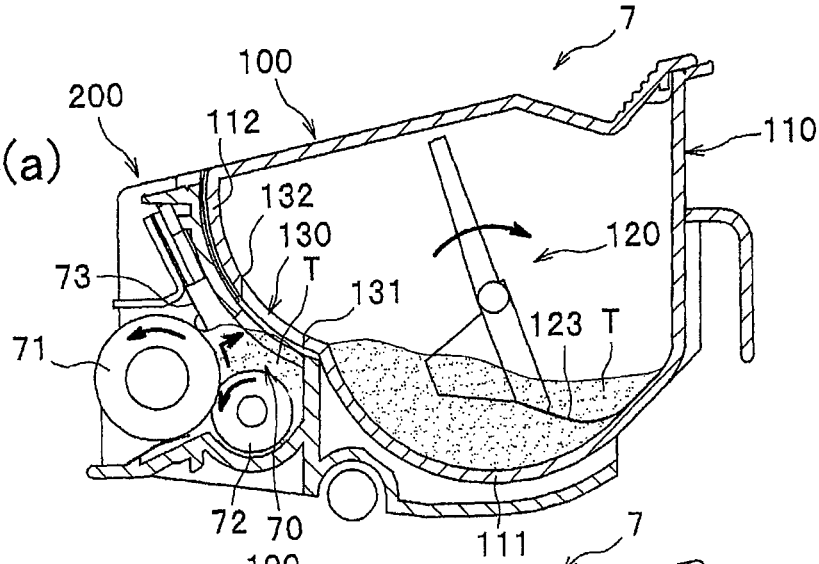
FIG. 4(*a*) is a cross-sectional view of the developing device showing a state where a new toner is just provided.
Figure 4B:
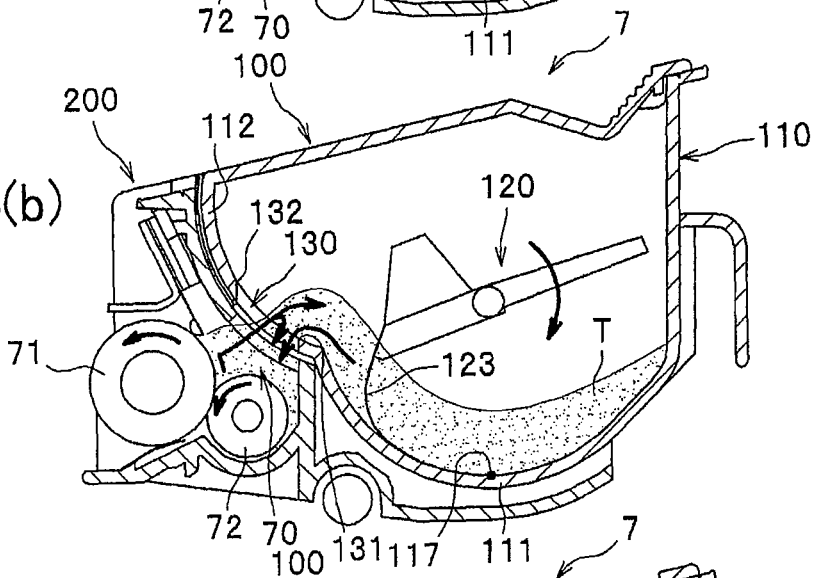
Figure 4C:
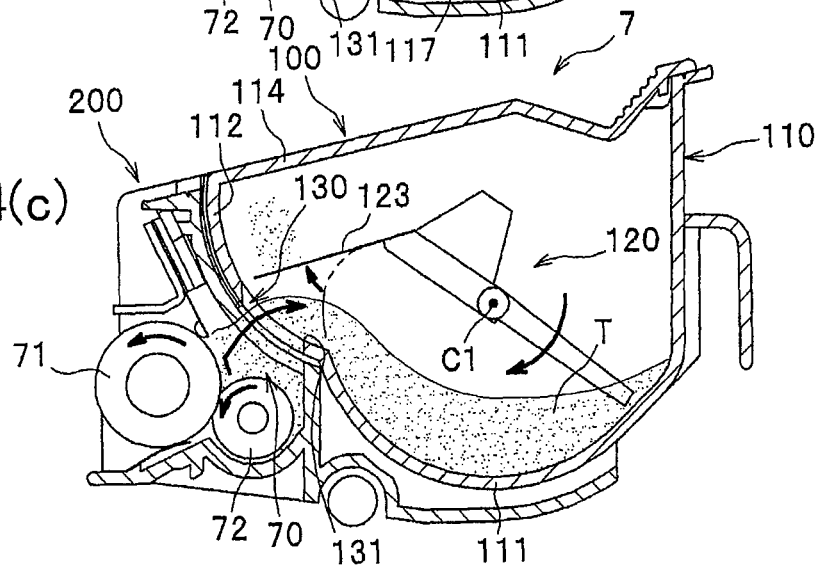

As shown in FIG. 4(*a*), upon rotation of the agitator 120 in the toner container 110, the free end portion of the sheet member 123 is advancing into the new toner T accommodated on the bottom wall 111 of the toner container 110. At the same time, in the developing chamber 70, degraded toner which has not been entered into a region between the developing roller 71 and the blade 73 will be moved away from (frontward) the developing roller 71 because of the rotation of the developing roller 71.

In the depicted embodiment, since the nipping region N between the developing roller 71 and the blade 73 is positioned higher than the upstream end 131 of the opening 130 and lower than the downstream end 132 thereof, the nipping region N is horizontally aligned with the opening 130. Thus, the degraded toner which has not been entered into a region between the developing roller 71 and the blade 73 will be moved to the opening 130. If the degraded toner in the developing chamber 70 has already been reached near the opening 130, a part of the degraded toner can be flowed into the toner container 110 through the opening 130.

As shown in FIG. 4(*b*), the sheet member 123 is flexed or bent while the tip end portion thereof is in sliding contact with the bottom wall 111 to convey new toner T toward the opening 130. In the depicted embodiment, since the inner surfaces of the bottom wall 111 and the subsequent protruding wall 112 are oriented diagonally upward toward the downstream end 132 of the opening 130, the new toner T can be smoothly conveyed to the opening 130 in comparison with a vertical conveyance of the new toner.

The new toner conveyed to a portion adjacent to the opening 130 will be supplied into the developing chamber 70 through the opening 130. Accordingly, an amount of new toner T in the developing chamber 70 will be increased. An inflow of the new toner into the developing chamber 70 will promote outflow of the degraded toner directing toward the opening by the rotation of the developing roller 71. Thus, a part of the degraded toner in the developing chamber 71 will be spillingly flowed into the toner cartridge 110 through the opening 130.

In the depicted embodiment, the rotation axis 72C of the toner supply roller 72 is positioned between the vertical plane PL1 passing through the upstream end 131 and the vertical plane PL2 passing through the downstream end 132 and below the opening 130, toner T will be accommodated on the upper surface of the toner supply roller 72 in the developing chamber 70. Further, when the new toner supplied from the toner container 110 reaches the level of the upstream end 131, the toner will collapse down toward the toner cartridge 110 through the opening 130, since the uppermost end 71A of the developing roller 71 is higher than the upstream end 131. In this way, effective toner circulation occurs between the developing chamber 70 and the toner container 110 through the opening 130.

On the other hand, a part of the degraded toner directing toward the opening 130 will be mixed with the newly supplied toner, and the toner mixture will be directed back to the developing chamber 70 by the advancing force of the new toner, whereupon mixing of the new toner with the degraded toner can be promoted.

Then as shown in FIG. 4(*c*), the sheet member 123 restores its linearity after departure from the upstream end 131. Because of the spring-back of the sheet member 123, the part of the toner T near the opening 130 will be directed upward and impinged on the upper wall 114, and then, the part of the toner T will be flowed downward along the inner surface of the protruding wall 112. As a result, degraded toner located near the opening 130 and near the protruding wall 112 will be mixed with the new toner T.

In the depicted embodiment, since the rotation axis C1 of the agitator 120 is positioned higher than the upstream end 131 and since the distance L1 is greater than the distance L2, the sheet member 123 can be completely stretched linearly to a position near the protruding wall 112. Accordingly, spring back force of the sheet member 123 can be efficiently provided upon restoring linearity of the sheet member 123, whereupon the toner near the opening 130 can be splashed vigorously toward the upper wall 114. Consequently, agitation and mixture of the new toner with the degraded toner near the opening 130 can be promoted.

On the other hand, a part of the remaining toner T near the opening 130 will be pushed into the toner cartridge 110 by the degraded toner T moving toward the opening 130 from the developing chamber 70 because of the rotation of the developing roller 71.

In the depicted embodiment, the inner surfaces of the protruding wall 112 and the bottom wall 111 are directing diagonally downward from the downstream end 132 toward the lowermost point 117. Therefore, the degraded toner T flowing into the toner container 110 will not be stagnant near the opening 130 and the protruding wall 112, but can be slidingly moved downward, along the diagonally downward surfaces, toward the bottom wall 111. Thus, the degraded toner flowing out of the developing chamber 70 and the new toner on the bottom wall 111 are subjected to agitation and mixture by the rotation of the agitator 120.

In this way, in the developing device 7 according to the depicted embodiment, sufficient toner circulation can be obtained between the developing chamber 70 and the toner container 110, and sufficient mixing of the degraded toner with the new toner occurs with the structure where the part of the toner container 110 protrudes toward the developing chamber 70.

Since smaller amount of the degraded toner remains in the developing chamber 70, a time period for mixing the degraded toner with the new toner to a certain level can be reduced. Accordingly, degradation of image immediately after replacement of an old toner cartridge 100 with a new toner cartridge (i.e., immediately after supply of new toner) can be restrained.

Further, since the part of the toner container 110 protrudes toward the developing chamber 70, a vertical height of the developing device 7 can be reduced without any reduction in an internal volume of the toner container 110.

Further, the inner surfaces of the protruding wall 112 and the bottom wall 111 are oriented diagonally downward from the downstream end 132 to the lowermost point 117, the toner T located near the opening 130 can be slidingly moved toward the bottom wall 111 along the diagonally downward surface during closure of the shutter 116. As a result, toner leakage amount out of the opening 130 can be reduced during closure of the shutter 116, i.e., during replacement of the toner cartridge 100 with a new cartridge 100.

Various modifications are conceivable. For example, in the above-described embodiment, the developing device 7 includes the developing unit 200 and the toner cartridge 100 detachably attached to the developing unit 200. However, a toner cartridge and a developing unit can be integral with each other, and a new toner can be directly replenished into the toner cartridge from an outside.

Further, in the above-described embodiment, the developing device 7 is detachably attached to the drum unit 6 provided with the photosensitive drum 61. However, the above-described process cartridge 5 is available as the developing device. In the latter case, the drum unit 6 and the developing device 7 can be integral with each other as the process cartridge 5.

Further, in the above-described embodiment, two arcuate walls are directly connected to each other to form a configuration spanning from the lowermost point 117 of the bottom wall 111 to the downstream end 132 of the protruding wall 112. However, an intermediate wall provided with an inner flat surface extending diagonally upward toward the downstream end 132 can be provided between the two arcuate walls. Thus, the inner surfaces from the lowermost point 117 to the downstream end 132 extend diagonally upward from the lowermost point 117 to the downstream end 132.

Further, in the above-described embodiment, the agitator 120 includes the agitation shaft 121, the arm 122 extending radially outward from the agitation shaft, and the sheet member 123 fixed to one free end portion of the arm 122. The length of the sheet member 123 is not limited to the length of the above-described embodiment. Further, the sheet member can be dispensed with.

Further, in the above-described embodiment, the developing device 7 is applied to the laser printer 1. However, the developing device can also be applied to a copying machine, or a multi-function device.

While the invention has been described in detail and with reference to the specific embodiment thereof, it would be apparent to those skilled in the art that various changes and modifications may be made therein without departing from the spirit and scope of the invention.

The invention claimed is:

1. A developing device comprising:

a developing unit comprising a developing frame defining therein a developing chamber, and a developing roller rotatably disposed in the developing chamber; and a developing agent unit comprising a developing agent container that accommodates therein a developing agent, and an agitator disposed in the developing agent container and rotatable about a rotation axis in a rotational direction to agitate the developing agent, the developing agent container including an arcuate bottom wall whose center of radius of a curvature is coincident with the rotation axis, and an arcuate protruding wall protruding from the bottom wall toward the developing chamber and positioned downstream of the bottom wall in the rotational direction, the arcuate protruding wall being formed with an opening providing a fluid communication between an interior of the developing agent container and the developing chamber, the bottom wall having a lowermost point, and the opening having a downstream end in the rotational direction in an operational state, the bottom wall and the arcuate protruding wall having inner surfaces extending diagonally upward from the lowermost point to the downstream end in the operational state, wherein the arcuate protruding wall is disposed above a supply roller.

2. The developing device as claimed in claim 1, wherein the opening has an upstream end in the rotational direction, and wherein the agitator comprises an agitation shaft defining the rotation axis; an arm extending from the agitation shaft, and a flexible sheet member fixed to the arm and having a tip end portion in sliding contact with the bottom wall to agitate the developing agent, the rotation axis being positioned higher than the upstream end in the operational state.

3. The developing device as claimed in claim 2, wherein the tip end portion and the rotation axis defines a first distance therebetween when the flexible sheet member provides its stretched state after departure from the bottom wall, and the upstream end and the rotation axis defines a second distance therebetween shorter than the first distance.

4. The developing device as claimed in claim 1, wherein the opening has an upstream end in the rotational direction; and wherein the developing roller has an upper portion positioned higher than the upstream end in the operational state.

5. The developing device as claimed in claim 4, wherein the developing unit further comprises a supply roller rotatably disposed in the developing chamber and in contact with the developing roller, the supply roller defining a roller axis; and wherein in the operational state, the roller axis is positioned between a first imaginary vertical plane passing through the upstream end and a second imaginary vertical plane passing through the downstream end.

6. The developing device as claimed in claim 1, wherein the developing roller has an outer peripheral surface, and wherein the developing unit further comprises a blade in contact with the outer peripheral surface to regulate a thickness of a layer of the developing agent formed on the outer peripheral surface.

7. The developing device as claimed in claim 6, wherein the opening has an upstream end in the rotational direction; and, wherein the outer peripheral surface and the blade defines a nip point therebetween, the nip point being positioned higher than the upstream end and lower than the downstream end in the operational state.

8. The developing device as claimed in claim 1, wherein the developing agent unit is a toner cartridge detachably attached to the developing unit.

9. A developing cartridge comprising:

a developing agent container that accommodates therein a developing agent, and an agitator disposed in the developing agent container and rotatable about a rotation axis in a rotational direction to agitate the developing agent, the developing agent container comprising;

an arcuate bottom wall whose center of radius of a curvature is coincident with the rotation axis, the arcuate bottom wall having a lowermost point and an inner surface; and an arcuate protruding wall having an inner surface and protruding from the bottom wall in a direction away from the rotation axis and positioned downstream of the bottom wall in the rotational direction, the arcuate protruding wall being formed with an opening through which the developing agent is discharged from the developing agent container to an outside, the opening having an upstream end and a downstream end in the rotational direction, the arcuate protruding wall having a center point defining a radius of a curvature of the arcuate protruding wall, the center point being positioned at a side of the rotation axis with respect to a first imaginary vertical plane passing through the upstream end in an operational state, the inner surfaces of the bottom wall and the arcuate protruding wall extending diagonally upward from the lowermost point to the downstream end in the operational state, wherein the center point defining the radius of the curvature of the arcuate protruding wall is positioned higher than the center of radius of the curvature of the arcuate bottom wall.

* * * * *